US007427723B2

(12) United States Patent
Watanabe

(10) Patent No.: US 7,427,723 B2
(45) Date of Patent: Sep. 23, 2008

(54) KEYBOARD APPARATUS

(75) Inventor: Keisuke Watanabe, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/811,240

(22) Filed: Jun. 7, 2007

(65) Prior Publication Data

US 2007/0295192 A1 Dec. 27, 2007

(30) Foreign Application Priority Data

Jun. 8, 2006 (JP) ..... 2006-159945

(51) Int. Cl.
*H01H 13/70* (2006.01)

(52) U.S. Cl. ..... 200/343; 200/5 A

(58) Field of Classification Search ..... 200/5 R, 200/5 A, 517, 341, 343; 84/744, 745, 20, 84/25, 423 R, 433, 719, 434; 341/22; 345/168; 400/490–496

See application file for complete search history.

(56) References Cited

U.S. PATENT DOCUMENTS

| | | | | |
|---|---|---|---|---|
| 4,689,455 | A * | 8/1987 | Watanabe | 200/534 |
| 4,892,024 | A | 1/1990 | Watanabe | |
| 4,914,999 | A * | 4/1990 | Masubuchi et al. | 84/423 R |
| 5,131,308 | A * | 7/1992 | Katsuta | 84/434 |
| 5,188,220 | A * | 2/1993 | Schmitt-Walter | 200/313 |
| 5,788,060 | A * | 8/1998 | Kuroda | 200/343 |
| 6,002,078 | A | 12/1999 | Yoshinaga et al. | |
| 6,369,309 | B1 * | 4/2002 | Nishida | 84/423 R |
| 7,019,237 | B2 * | 3/2006 | Hong | 200/296 |
| 7,126,069 | B2 * | 10/2006 | Mukougawa et al. | 200/293 |

FOREIGN PATENT DOCUMENTS

| | | |
|---|---|---|
| JP | 08-123419 | 5/1996 |
| JP | 2628656 | 4/1997 |
| JP | 11-213813 | 8/1999 |
| JP | 2001-215968 | 8/2001 |
| JP | 2001-306075 | 11/2001 |
| JP | 2003-066965 | 3/2003 |

* cited by examiner

*Primary Examiner*—Michael A Friedhofer
(74) *Attorney, Agent, or Firm*—Morrison & Foerster LLP

(57) ABSTRACT

A keyboard apparatus constructed to be capable of reducing the depth size thereof and permitting a key unit to be mounted to a key frame with a simple operation. Hinges are extended downward from rear ends of black key main bodies of a black key unit in the vertical direction, and are connected at their lower ends to a common-to-black-keys base end. The black key main bodies are pivotable via the hinges relative to the common-to-black-keys base end in the key depression/release direction. Similarly, white key main bodies of first and second white key units are pivotable via hinges relative to a common base end in the vertical direction. The key frame is formed at its rear portion with a recessed groove over the entire width of all keys and formed with elastic members extending in the front-to-rear direction on the front and rear sides of the recessed groove. Using elastic deformations of the elastic members, a common-to-all-keys base end of the key unit is fitted and fixed to the recessed groove.

5 Claims, 12 Drawing Sheets

KEYBOARD APPARATUS

BACKGROUND OF THE INVENTION

1. Field of the Invention

The present invention relates to a keyboard apparatus having a key frame to which is mounted a key unit that includes a plurality of key main bodies supported via hinges for pivotal motion by a common base end.

2. Description of the Related Art

Conventionally, there has been known a keyboard apparatus in which a key frame is mounted with a key unit having a plurality of key main bodies supported for pivotal motion by a common base end via thin plate-like hinges. For example, Japanese Patent No. 2628656 discloses a key unit comprised of two white key units and one black key unit, which are disposed in a stacked relation. The white and black key units each have hinges horizontally extended rearward substantially parallel to key depression surfaces of the keys, and therefore, these key units are long in size in a longitudinal direction of keys. As a consequence, the keyboard apparatus is large in depth size.

On the other hand, Japanese Laid-open Patent Publication No. 2001-215968 discloses a key unit in which hinges and a common base end are vertically extended downward from rear parts of key main bodies, thereby reducing the size of the key unit in the longitudinal direction of the keys.

However, in the key unit disclosed in Japanese Laid-open Patent Publication No. 2001-215968, the common base end is fixed at a plurality of portions to the key frame using screws. This poses a problem that many man-hours are required in mounting the key unit to the key frame and the number of component parts increases. When mounting the key unit to the key frame, an operator ordinarily performs an operation of placing the key unit in a desired position from the front side of the keyboard apparatus. Nevertheless, the keyboard apparatus disclosed in Japanese Laid-open Publication No. 2001-215968 is constructed to threadedly engage screws from the rear side of the keyboard apparatus, which requires an additional step of such as inverting the keyboard apparatus front to back, posing a problem of poor workability.

SUMMARY OF THE INVENTION

The present invention provides a keyboard apparatus capable of reducing a depth size of the keyboard apparatus and mounting a key unit to a key frame with a simple operation.

According to the present invention, there is provided a keyboard apparatus comprising a key unit having a plurality of key main bodies each of which is adapted to be supported for pivotal motion in a key depression/release direction by a common base end via a corresponding one of thin plate-like hinges, and a key frame having a base end support adapted to fixedly support the common base end of the key unit, wherein the hinges of the key unit are formed in a direction to cross the key depression surfaces of the key main bodies and parallel to a key arrangement direction, and wherein the common base end is fitted and fixed to the base end support using elastic deformation of at least one of the common base end of the key unit and the base end support of the key frame.

According to the present invention, it is possible to reduce the depth size of the keyboard apparatus and mount the key unit to the key frame with a simple operation.

One of the common base end and the base end support can be formed with a recessed groove extending in the key arrangement direction, and another of the common base end and the base end support can be formed in the key arrangement direction with a ridge-like protrusion extending in the key arrangement direction and adapted to be fitted to the recessed groove.

In this case, the fitting and fixing construction of the keyboard apparatus can be simplified.

The key unit can be comprised of at least one white key unit and one black key unit which are disposed in a stacked relation, the common base end fitted and fixed to the base end support can be comprised of a common-to-white-keys base end of the white key unit and a common-to-black-keys base end of the black key unit, which are stacked together, the base end support can be formed with a recessed groove extending in the key arrangement direction, and the common base end can be formed with a ridge-like protrusion fitted to the recessed groove extending in the key arrangement direction.

In this case, the fitting and fixing construction of the keyboard apparatus can be simplified, and a plurality of key units can be put into one piece and can be mounted to the key frame with a simple operation.

The key unit can include position restriction means adapted to restrict a positional relationship between the white key unit and the black key unit in the key arrangement direction, in a state where the white key unit and the black key unit have been stacked together but have not been mounted to the key frame.

In this case, a plurality of key units can easily be handled when they are put into one piece for being mounted to the key frame, thereby further improving the workability.

One of the common base end and the base end support can be formed with protrusions, and another of the common base end and the base end support can be formed with fit portions adapted to be fitted with the protrusions when the common base end is fitted and fixed to the base end support, a position of the common base end relative to the base end support in the key arrangement direction and in a vertical direction can be restricted when the protrusions are fitted to the fit portions.

In this case, the common base end can naturally be prevented from being detached from the base end support by being fitted and fixed to the base end support, whereby a fixed state can be stabilized and workability can be improved.

Further features of the present invention will become apparent from the following description of exemplary embodiments (with reference to the attached drawings).

DETAILED DESCRIPTION OF THE PREFERRED EMBODIMENTS

The present invention will now be described in detail below with reference to the drawings showing preferred embodiments thereof.

First Embodiment

Figure 1:
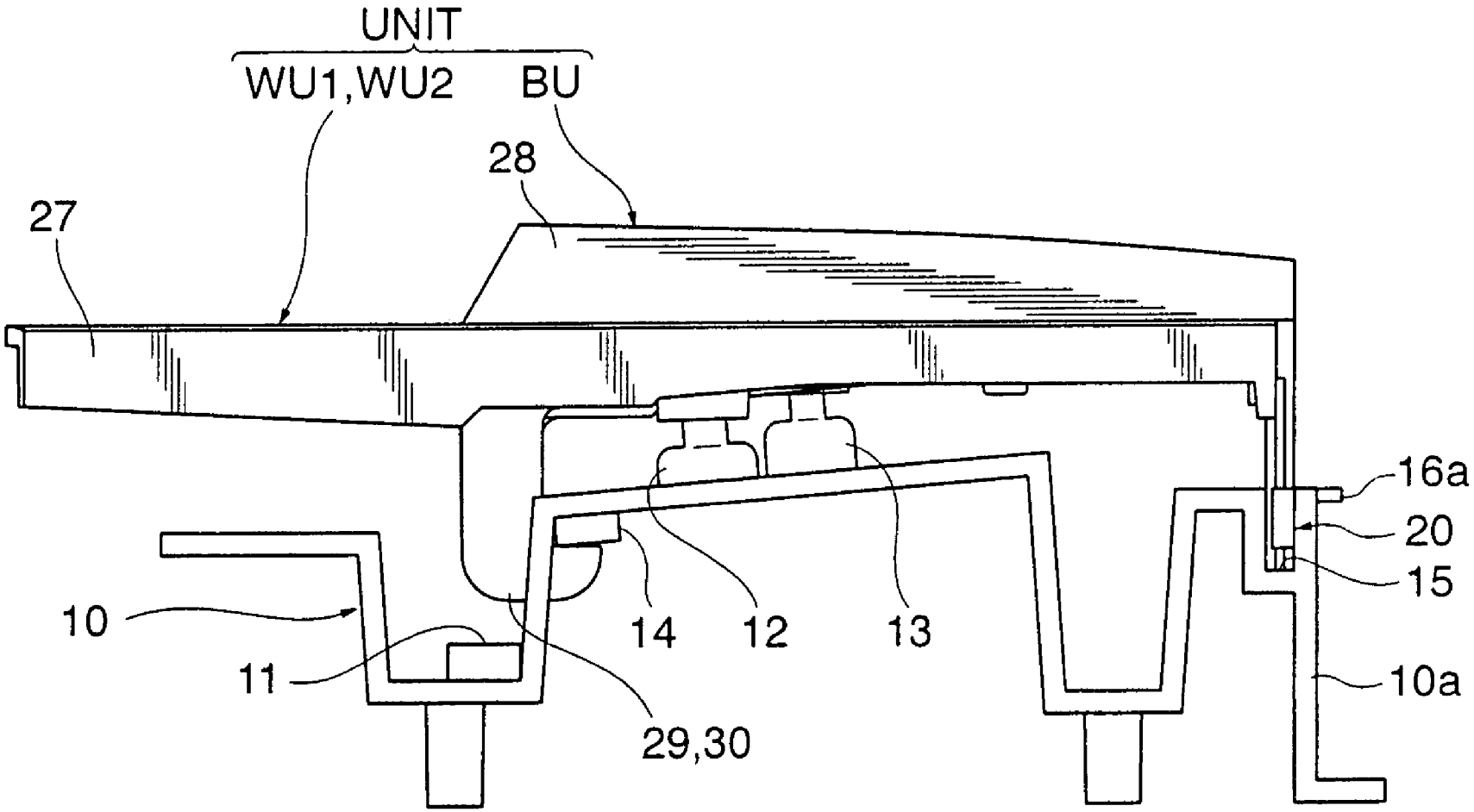
FIG. 1 is a right side view showing an essential part of a keyboard apparatus according to a first embodiment of the present invention.

FIG. 1 is a right side view showing an essential part of a keyboard apparatus according to a first embodiment of the present invention. This keyboard apparatus is constructed as an electronic musical keyboard instrument, and includes a key frame 10 to which a key unit UNT is mounted. In the following, a side of the keyboard apparatus toward a player (the left side in FIG. 1) will be referred as the front side, and the left-to-right direction will be determined in reference to the player.

Figure 2A:
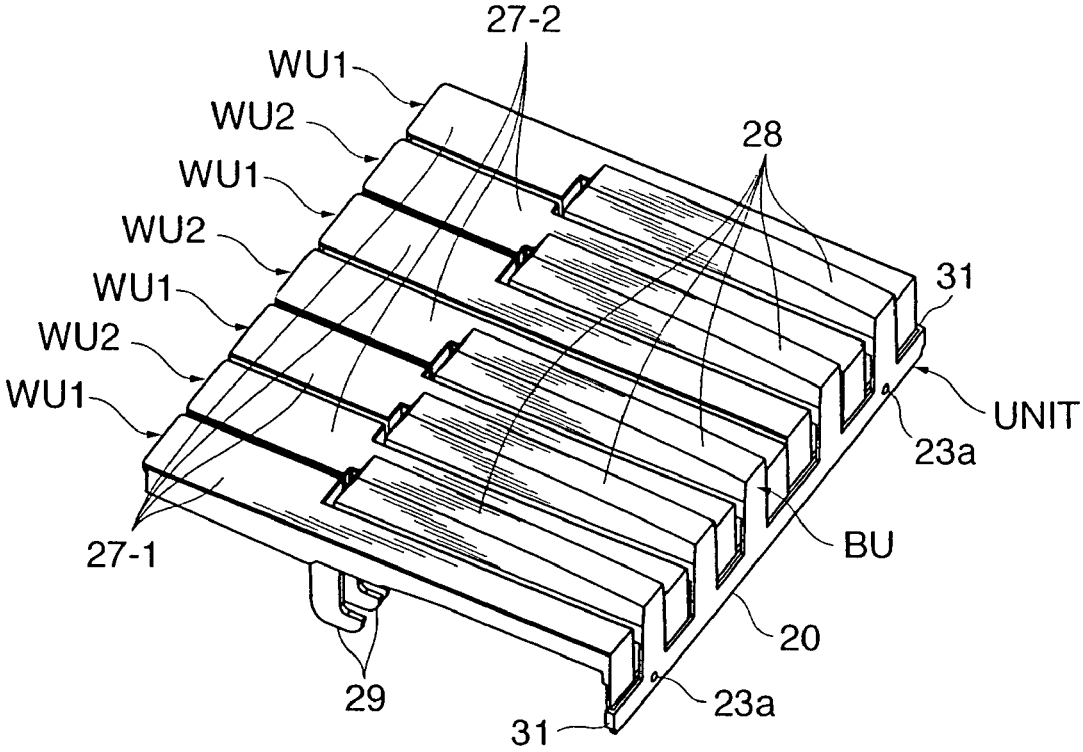
FIG. 2A is a perspective view of a key unit.
Figure 2B:
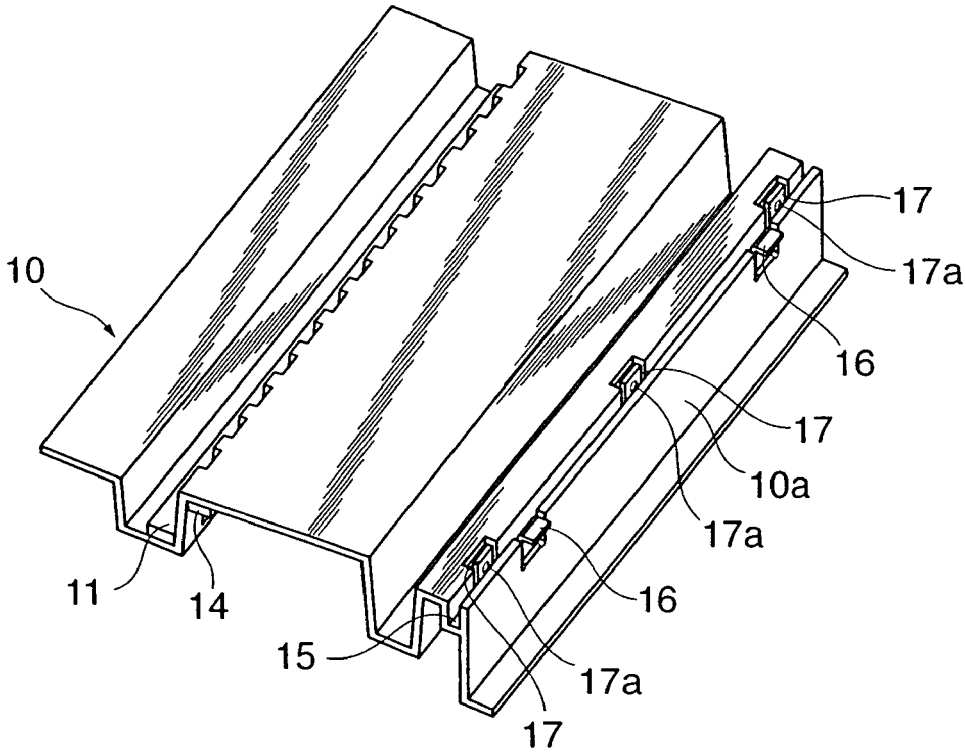
FIG. 2B is a perspective view of a key frame.

FIG. 2A is a perspective view of the key unit UNT, and FIG. 2B is a perspective view of the key frame 10. As shown in FIG. 2A, the key unit UNT is constructed to cover one octave, for instance, and includes first and second white key units WU1, WU2 each having a plurality of white key main bodies 27 and a black key unit BU having a plurality of black key main bodies 28, these three units being assembled in a stacked relation. The key frame 10 is made of resin or metal, is constructed into one piece, and has a length extending over the entire width of all keys. In FIG. 2B, only a one-octave part of the key frame 10 is shown.

As shown in FIGS. 1 and 2B, at a location below a front portion of the key frame 10, there is provided a key depression stopper 11 adapted to restrict lower limit positions of the white and black key main bodies 27, 28 at the time of key depression. At a location above the front portion of the key frame 10, an upper limit stopper 14 is provided for restricting upper limit positions of the white and black key main bodies at the time of key release. At an intermediate portion of the key frame 10 as seen in the front-to-back direction, there are disposed two-make-contact key depression switches 12, 13, which correspond to respective ones of the white and black key main bodies 27, 28. It should be noted that FIG. 2B omits illustrations of portions of the key frame 10 to which the key depression switches 12, 13 are mounted. The key frame 10 has its rear portion 10*a* formed with a recessed groove 15 over the entire key width. A common-to-all-keys base end 20 (a base end common to all the keys) of the key unit UNT, described in detail later, is adapted to be fitted to and supported by the recessed groove 15. The recessed groove 15 is a substantially U-shape as seen from side and has an opening that opens upward.

Figure 3:
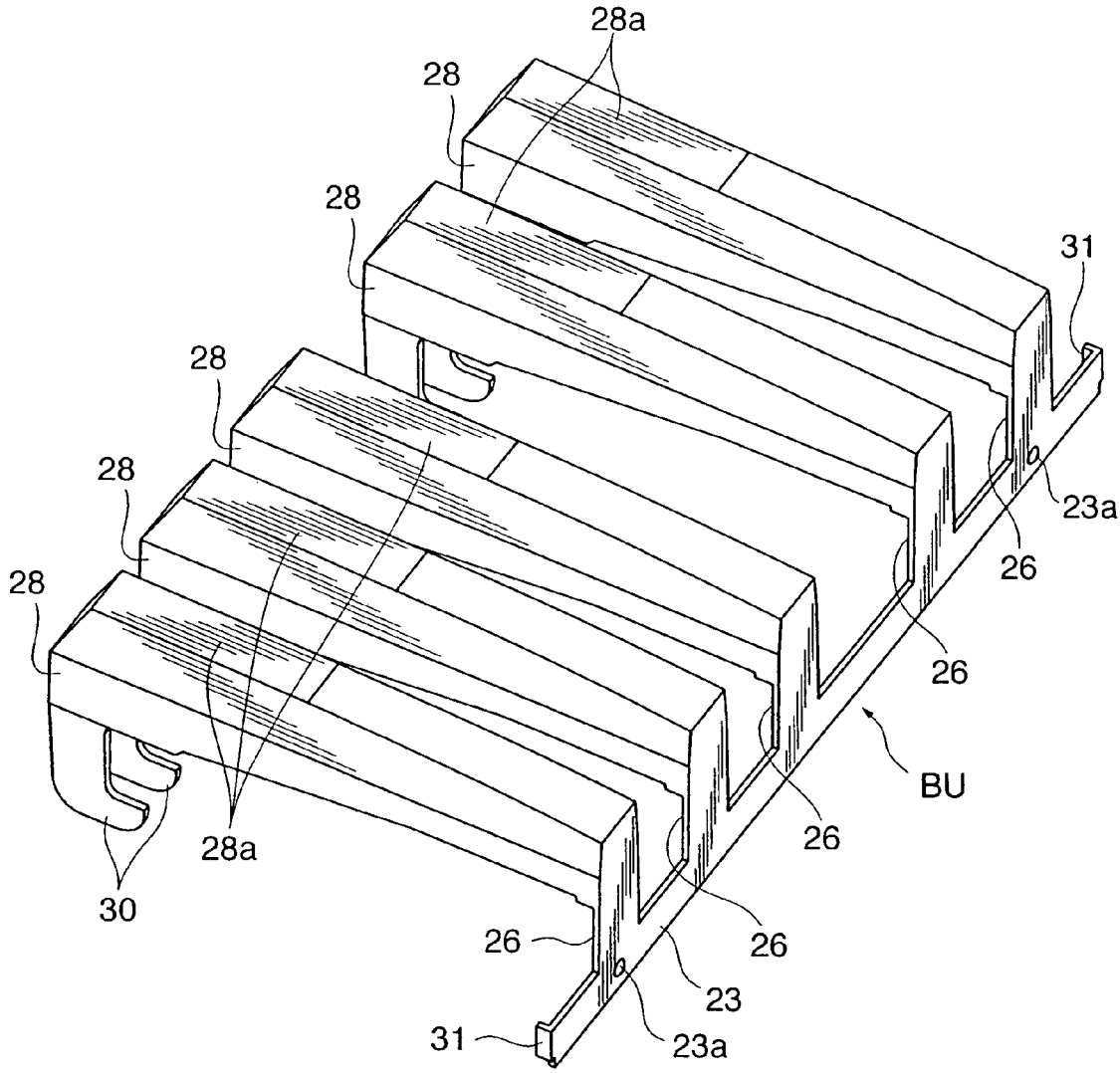
FIG. 3 is a perspective view of a black key unit.
Figure 4:
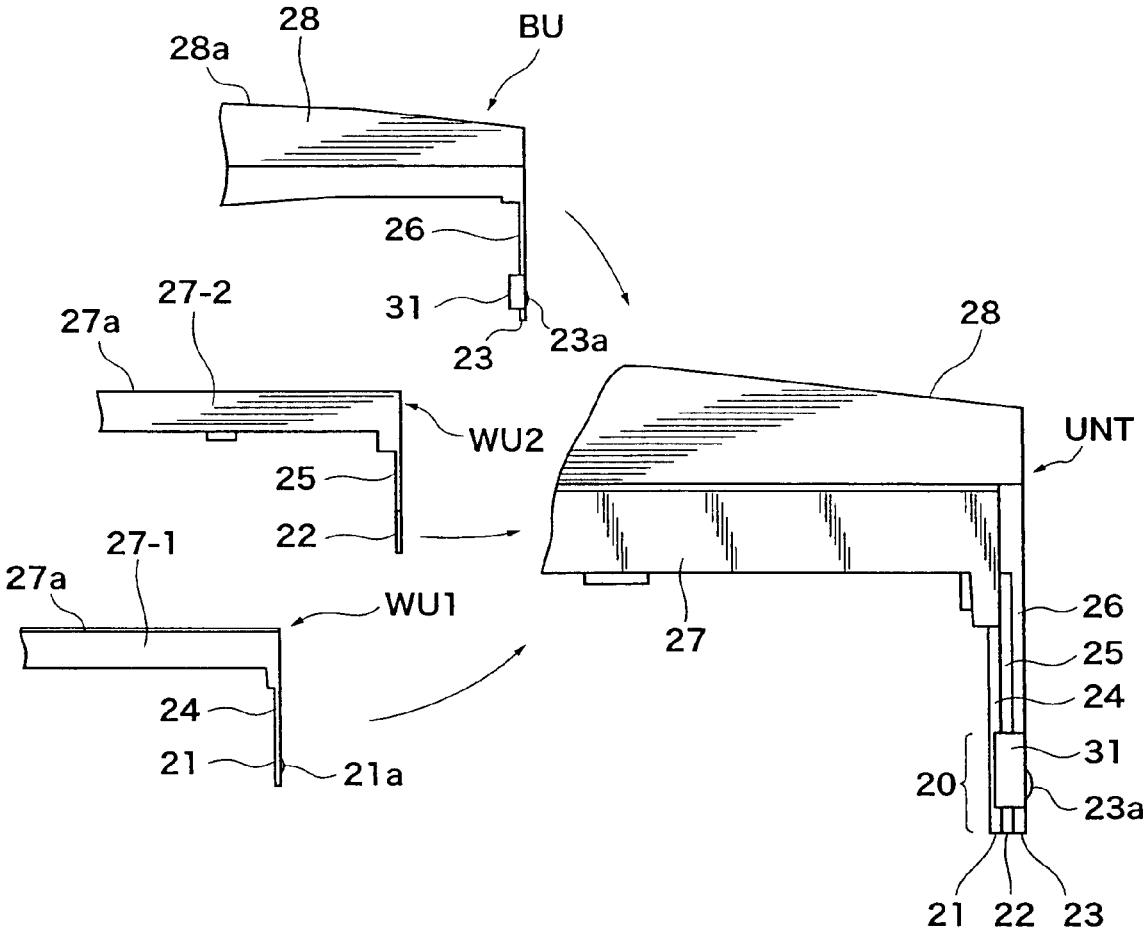
FIG. 4 is a side view showing rear halves of a white key unit, the black key unit, and the key unit.

FIG. 3 is a perspective view of the black key unit BU, and FIG. 4 is a side view showing rear halves of the white key units WU1, WU2, the black key unit BU, and the key unit UNT.

As shown in FIGS. 2A, 3 and 4, the black key unit BU includes black key main bodies 28 corresponding to respective ones of tone pitches C#, D#, F#, G#, and A#. As shown in FIGS. 2A and 4, the first white key unit WU1 includes white key main bodies 27-1 corresponding to tone pitches C, E, G, and B, and the second white key unit WU2 includes white key main bodies 27-2 corresponding to tone pitches D, F, and A. In the following, the white key main bodies 27-1, 27-2 are simply referred to as "white key main bodies 27" when they are referred to as without distinction. The white and black key main bodies 27, 28 have front halves whose upper surfaces function as key depression surfaces 27*a*, 28*a*. The white key units WU1, WU2 and the black key unit BU are made of resin and constructed by integral forming.

As shown in FIGS. 1 to 3, the white and black key main bodies 27, 28 each have a front portion formed with a stopper contact member 29 or 30 extending downward for contact with the key depression stopper 11 at the time of key depression.

As shown in FIGS. 3 and 4, the black key main bodies 28 of the black key unit BU each have a rear end from which a thin plate-like hinge 26 is extended downward. The hinges 26 are connected at their lower ends to a common-to-black-keys base end 23 (a base end common to the black keys) having a length corresponding to one octave. The hinges 26 and the common-to-black-keys base end 23 are the same in thickness and extend in a vertical direction and in parallel to the key arrangement direction (the left-to-right direction). Each of the black key main bodies 28 is supported via the hinge 26 for pivotal motion relative to the common-to-black-keys base end 23 in the vertical direction (in the key depression/release direction). The common-to-black-keys base end 23 is formed at its left and right ends with temporary joint members 31 that prevent the assembled key unit UNT from being disassembled in the left-to-right direction. The temporary joint members 31 are formed into a plate-like shape and extended forward from the left or right end of the common-to-black-keys base end 23.

As shown in FIG. 4 and as in the case of the black key unit BU, each of the white key main bodies 27-1 of the first white key unit WU1 is formed at its rear end with a hinge 24 extending downward therefrom. The hinge 24 is connected at its lower end thereof to a first common-to-white-keys base end 21 (a base end common to white keys corresponding to tone pitches C, E, G, and B). Each of the white key main bodies 27-2 of the second white key unit WU2 is formed at its rear end with a hinge 25 extending downward therefrom. The hinge 25 is connected at its lower end to a second common-to-white-keys base end 22 (a base end common to white keys corresponding to tone pitches D, F, and A). Each white key main body 27 is supported via a corresponding hinge 24 or 25 for vertically pivotal motion relative to the first or second common-to-white-keys base end 21 or 22. The hinges 24 and the first common-to-white-keys base end 21 are the same in thickness and extend vertically or extend perpendicular to the key depression surfaces 27*a* and parallel to the key arrangement direction. The hinges 25 and second common-to-white-keys base end 22 are the same in thickness and extend vertically or extend perpendicular to the key depression surfaces 27*a* and parallel to the key arrangement direction.

In assembling the first and second white key units WU1, WU2 and the black key unit BU into the key unit UNT, the first and second common-to-white-keys base ends 21, 22 and the common-to-black-keys base end 23, which are common base ends of the units WU1, WU2 and BU, are sequentially disposed in a stacked relation from the front side of the keyboard apparatus, as shown in FIG. 4. The common base ends 21 to 23 made in contact with one another and stacked together form the above described common-to-all-keys base end 20.

When any of the key depression switches 12, 13 is depressed or released by a corresponding one of the white and black key main bodies 27 and 28, a key depression/release operation is detected. Based on the detected key depression/release operation, a musical tone is generated by a musical tone generating section, not shown.

Figure 5:
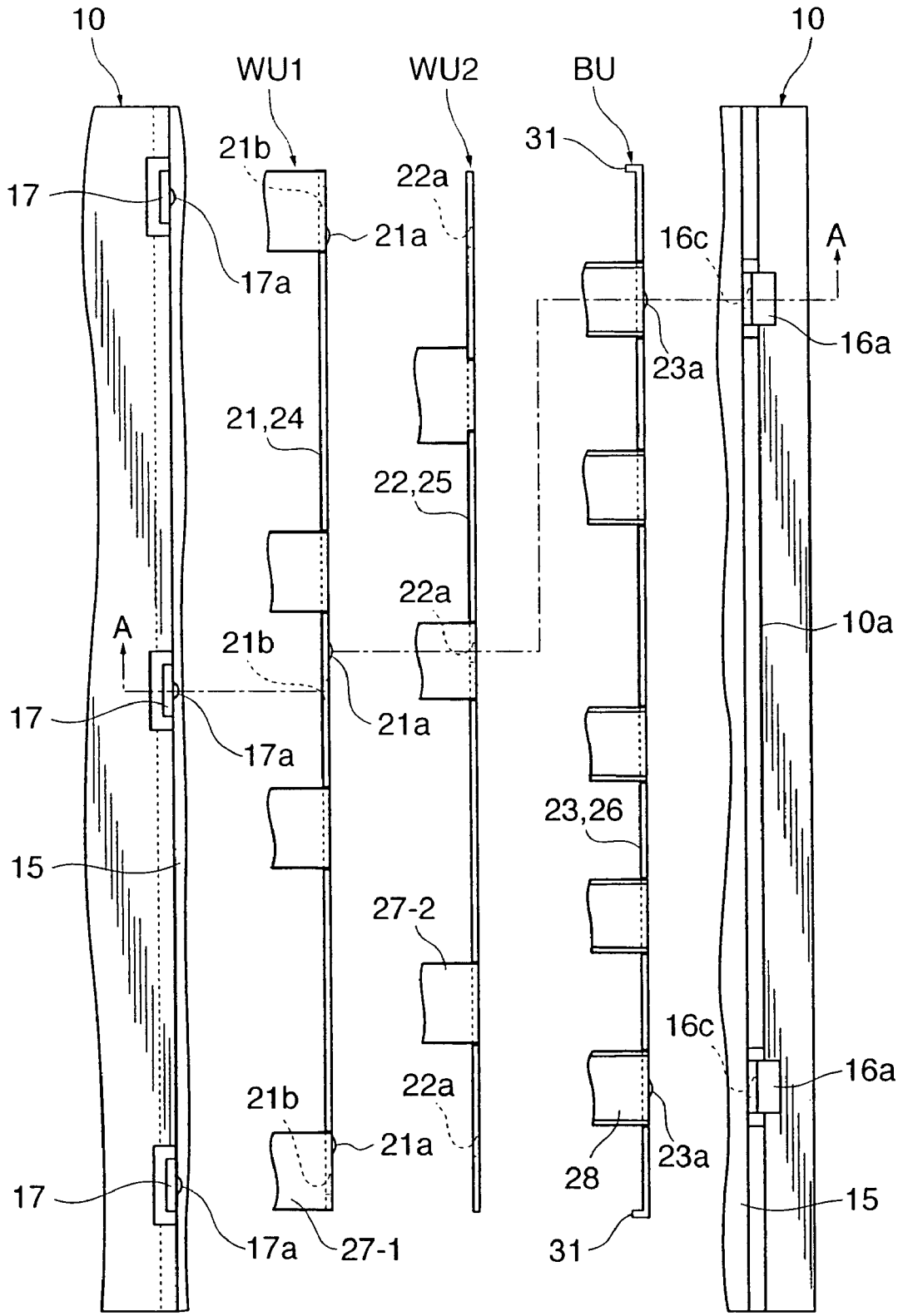
FIG. 5 is a plan view separately showing the key frame and the key unit in a state before they are assembled together.
Figure 6:
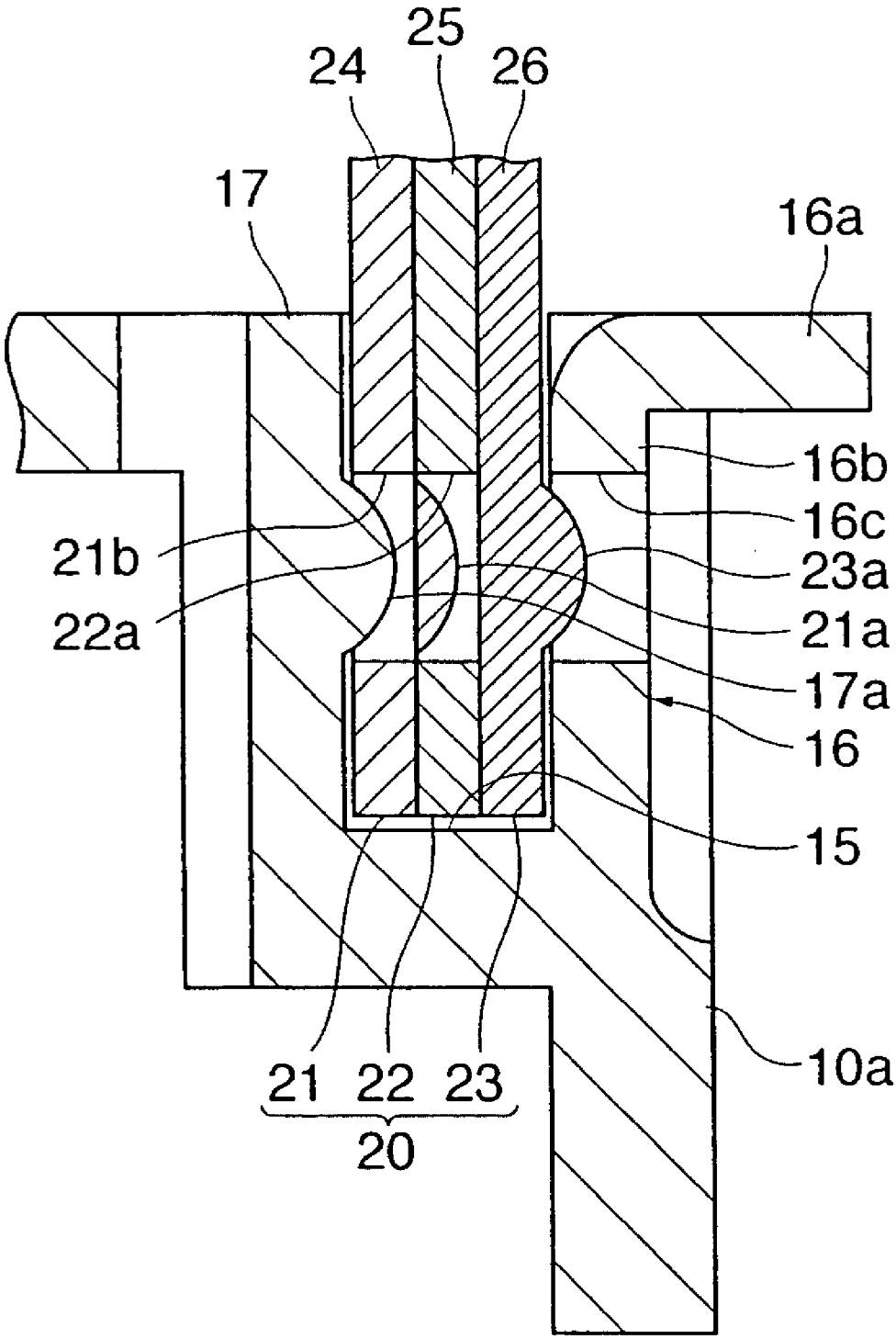
FIG. 6 is a section view taken along line A-A in FIG. 5.

FIG. 5 is a plan view separately showing the key frame 10 and the key unit UNT in a state before they are assembled, and FIG. 6 is a section view taken along line A-A shown in FIG. 5. On the leftmost and rightmost sides in FIG. 5, there are shown front-side and rear-side parts of the rear portion 10*a* of the key frame 10 with respect to the recessed groove 15. Between the front-side and rear-side parts of the rear portion of the key frame, rear portions of the key units WU1, WU2, and BU are shown.

As shown in FIGS. 2B and 5, the key frame 10 is integrally formed with elastic members 17 so as to project therefrom at a plurality of locations (for example, three locations) which are on the front-side part of the rear portion 10*a* thereof in the key arrangement direction respect to the recessed groove 15. The elastic members 17 are formed so as to extend upward and formed thin along the key arrangement direction in such a manner that upper ends of the elastic members can be deformed in the front-to-back direction. The elastic members 17 are each integrally formed at a rear surface with a protrusion 17*a*, which is formed in a circular shape as seen from rear so as to project from the elastic member (also refer to FIG. 6).

As shown in FIGS. 2B, 5 and 6, the key frame 1 is integrally formed with elastic members 16 so as to project therefrom at a plurality of locations (for example, two locations) on the rear-side part of the rear portion 10*a* thereof in the key arrangement direction with respect to the recessed groove 15. The elastic members 16 each have a flexible portion 16*b* extended upward. The flexible portion 16*b* is formed thin along the key arrangement direction in such a manner that an upper end thereof can be deformed in the front-to-back direction. As shown in FIG. 6, the flexible portion 16*b* is formed with an operation pawl portion 16*a* extending from an upper part of the flexible portion 16*b* so as to be bent rearward. The flexible portion 16*b* is formed with a circular fitting hole 16*c* extending therethrough in the front-to-back direction.

A distance between the rear surface of the elastic member 17 and the front surface of the flexible portion 16*b* is the same as the width of the recessed groove 15 as seen in the front-to-back direction. The just-mentioned distance and the width are each set to be equal to the total thickness of the common base ends 21 to 23, i.e., the thickness of the common-to-all-keys base end 20 in the front-to-back direction.

As shown in FIGS. 5 and 6, the first common-to-white-keys base end 21 of the first white key unit WU1 is formed with circular fitting holes 21*b* corresponding to the protrusions 17*a* of the key frame 10 so as to extend therethrough in the front-to-back direction. The first common-to-white-keys base end 21 is integrally formed at its rear surface with protrusions 21*a*, which are the same in shape as the protrusion 17*a*, so as to project therefrom at locations different from the locations of the fitting holes 21*b* as viewed in the key arrangement direction (also refer to FIG. 4).

The second common-to-white-keys base end 22 of the second white key unit WU2 is formed with fitting holes 22*a* similar to the fitting holes 21*b* and corresponding to the protrusions 21*a* of the first white key unit WU1 so as to extend therethrough in the front-to-rear direction. The common-to-black-keys base end 23 of the black key unit BU is integrally formed at its rear surface with protrusions 23*a*, corresponding to the fitting holes 16*c* of the key frame 10 and being the same in shape as the protrusions 17*a*, so as to project therefrom (also refer to FIGS. 2A, 3, and 4).

The key unit UNT is assembled in advance and then mounted to the key frame 10. First, the second common-to-white-keys base end 22 of the second white key unit WU2 is superimposed on the rear surface of the first common-to-white-keys base end 21 of the first white key unit WU1, and the protrusions 21*a* are caused to be fitted into the fitting holes 22*a*. As a result, the positions of the first white key unit WU1 and the second white key unit WU2 are restricted in all of the front-to-back direction, the left-to-right direction and the vertical direction. Then, the common-to-black-keys base end 23 of the back key unit BU is superimposed on the rear surface of the second common-to-white-keys base end 22 and is positioned so that the common base ends 21, 22 held between the temporary joint members 31 disposed on the both sides thereof. As a result, the positions of the white key units WU1, WU2 and the black key unit BU are restricted in the front-to-back direction, and are temporarily restricted in the left-to-right direction.

Then, the common-to-all-keys base end 20 of the key unit UNT, which is comprised of the white and black key units stacked in three layers, is caused to be fitted to the recessed groove 15 of the key frame 10 from above. As a result, the protrusions 17*a* of the elastic member 17 are caused to be fitted in the fitting holes 21*b* of the first common-to-white-keys base end 21 and the protrusions 23*a* of the common-to-black-keys base end 23 are caused to be fitted into the fitting holes 16*c* of the elastic members 16 (refer to FIG. 6). At that time, the elastic members 17, 16 having elasticity are once deformed to the front side and the rear side, and then restored to their original states when the protrusions 17*a*, 23*a* are fitted into the fitting holes 21*c*, 16*c*. As a consequence, the common-to-all-keys base end 20 is elastically fitted and fixed to the recessed groove 15, whereupon the mounting of the key unit UNT to the key frame 10 is completed.

In the mounting state, as shown in FIG. 6, since the protrusions 23*a* and the fitting holes 16*c* are fitted to one another, the position of the black key unit BU relative to the key frame 10 is restricted in the left-to-right direction and in the vertical direction. Since the protrusions 17*a* and the fitting holes 21*b* are fitted to one another, the positions of the first and second white key units WU1, WU2 relative to the key frame 10 are restricted in the left-to-right direction and in the vertical direction.

In a strict sense, the lower end surface of the common-to-all-keys base end 20 is slightly floated from a bottom surface of the recessed groove 15. However, when an excessive force is applied to the common-to-all-keys base end 20 from above, the common-to-all-keys base end 20 is displaced downward and the lower end surface thereof can be made in contact with the bottom surface of the recessed groove 15. Specifically, the protrusions 17*a*, 23*a* urge lower portions of the fitting holes 21*b*, 16*c*, thereby slightly expanding the elastic members 17, 16 in the front-to-back direction, and the protrusions 17*a*, 23*a* and the fitting holes 21*b*, 16*c* are temporarily dislocated from one another. Thus, a force applied to the common-to-all-keys base end 20 is mainly received by the bottom surface of the recessed groove 15. As a result, an excessive external force is prevented from being applied, as a large load, to the protrusions 17*a*, 23*a* and the fitting holes 21*b*, 16*b*.

In order to dismount the key unit UNT from the key frame 10, two pawl portions 16*a* are operated so as to cause the flexible portions 16*b* to be deformed in the rear direction, and then the common-to-all-keys base end 20 is pulled off upward.

After the key unit UNT is assembled, when a key depression operation is performed, a corresponding one of the white and black key bodies 27, 28 is pivoted downward due to the presence of elasticity of the hinge 24, 25, or 26, and thus a lower end of the stopper contact member 29 or 30 is brought in contact with the key depression stopper 11, whereby a key depression completed state is reached. When a key depression is released, a corresponding one of the white and black key main bodies 27, 28 is caused to be pivoted upward due to the presence of elasticity of the hinge 24, 25, or 26, and thus an upper end of the stopper contact member 29 or 30 is brought in contact with the upper limit stopper 14. Therefore, the white or black key main body 27 or 28 is restored to its key-nondepressed position.

Since the hinges 24 to 26 extend downward at positions below the key depression surfaces 27*a*, 28*a*, much proper loci of the key depression surfaces 27*a*, 28*a* at the time of key depression can be attained as compared to a hinge arrangement in which hinges extend upward and an ordinary horizontal hinge arrangement. Specifically, at the time of key depression, an arbitrary point on the key depression surface 27*a* or 28*a* (hereinafter referred to as "the key depression point") ordinarily performs a pivotal motion on a circle centered on a pivotal fulcrum. Thus, considering a motion in the front-to-rear direction, the key depression point moves rearward with the advancement of key depression.

In addition, the key depression point is displaced by hinge deformation in the case of a hinge-type key. For example, in the case of a horizontal hinge, a rearward displacement of the key depression point is caused by a front hinge portion being deformed downward. In the arrangement in which the hinge extends upward, a rearward displacement of the key depression point is caused by a lower hinge portion being deformed rearward. The rearward displacement of the key depression point disadvantageously affects delicate performance expression, if an amount of the rearward displacement is large.

On the other hand, according to the present embodiment, an upper portion of the hinge 24, 25, or 26 is deformed forward at the time of key depression, and the key depression point is rather displaced forward depending on the deformation of the hinge 24, 25, or 26. Thus, the deformation of the hinge 24, 25, or 26 exerts in a direction to cancel the rearward displacement caused by the pivotal motion around the pivotal fulcrum. As a result, the rearward displacement of the key depression point in a forward stroke of key depression is suppressed.

As a consequence, a substantial displacement of the key depression point in the front-to-rear direction is made small, so that the locus of the key depression point is such that the key depression point nearly straightly falls down. Such locus is close to a locus of the key depression point that is observed in the case of a key of an acoustic grand piano, which is elongated and adapted to be pivoted around a fulcrum provided at a lower portion of the key. Accordingly, proper loci of the key depression surfaces 27*a*, 28*a* can be attained, which contributes to improvement in expression.

According to the key unit UNT of this embodiment, the hinges 24 to 26 extend downward in the vertical direction perpendicular to the key depression surfaces 27*a* and in parallel to the key arrangement direction, thus making it possible to shorten the dimension of the key unit UNT as viewed in the longitudinal direction of the keys and to suppress the depth dimension of the keyboard apparatus. Due to elastic deformation of the elastic members 16, 17, the common-to-all-keys base end 20 of the key unit UNT is fitted and fixed to the recessed groove 15. Thus, as compared to an arrangement where it is essentially required to fix the key unit to the key frame using screws or the like, the key unit UNT can be assembled to the key frame 10 with a simple operation. In particular, since it is unnecessary to perform screw clamp from rear, a process such as for inverting the keyboard apparatus front to back can be eliminated, thus improving workability. It should be noted that in actual products, in addition to the fixing by means of elastic fitting, more perfect fixing means such as screw clamp may be added without any trouble.

The common-to-all-keys base end 20 is a ridge-like protrusion having a shape that can be fitted to the recessed groove 15 and thus the fitting and fixing arrangement is simple. When the common-to-all-keys base end 20 is fitted to the recessed groove 15, the protrusions 17*a*, 23*a* and the fitting holes 21*b*, 16*c* are fitted together, and therefore, the common-to-all-keys base end 20 is naturally prevented from being detached from the recessed groove 15, which achieves a stable fixing state and improved workability.

The common-to-all-keys base end 20 is formed by stacking the common base ends 21 to 23 in layer, and besides the three key units WU1, WU2, BU are temporarily positioned by the temporary joint members 31 so as not to be disassembled in the left-to-right direction. Thus, it is easy to handle the three key units WU1, WU2, BU when they are assembled together and mounted to the key frame 10, thereby further improve workability.

It should be noted that an arrangement for temporarily restricting the positions of the white and black key units WU1, WU2, BU in the left-to-right direction before they are assembled to the key frame 10 is not limited to one using the temporary joint members 31. For example, a member similar to the temporary joint member 31 may be provided in either one of the white key units WU1, WU2 so as to extend rearward therefrom. Alternatively, the second common-to-white-keys base end 22 and the common-to-black-keys base end 23 may be provided with a protrusion and a fitting hole in combination, which are similar to the above described protrusion 21 and the fitting hole 22*a*.

It should be noted that both the fitting holes 16*c* of the key frame 10 and the protrusions 23*a* of the common-to-black-keys base end 23 may be removed. Specifically, when the key depression surface 27*a* of a key, especially a part thereof close to the front end of the key, is depressed, the white key main body 27 is applied with a force to lift up the rear end thereof around a fulcrum formed by the stopper contact member 29 (refer to FIG. 2A) made in contact with the key depression stopper 11. On the other hand, since the stopper contact member 30 extends downward from the frontmost end of the black key main body 28 (refer to FIG. 3), the black key main body 28 is not applied at its rear end with an upward urging force exerting around a fulcrum formed by the stopper contact member 30, even if the key depression surface 28*a* of the key concerned is depressed at its distal end.

As a consequence, during the normal performance use, the common-to-black-keys base end 23 is not applied with a force to cause the same to be detached upward from the recessed groove 15. Thus, as described above, it is possible to eliminate the fitting holes 16*c* and the protrusions 23*a* without any trouble. To adopt such an arrangement, the common-to-black-keys base end 23 may be constructed such that a lower end thereof is made in contact with a bottom surface of the recessed groove 15 to apply a restriction for maintaining the base end in its proper vertical position. In that case, in place of the temporary joint members 31, a mechanism, which is a combination of a contacting part and a contacted part or a combination of a protrusion and a recess for positioning the base end 23 and the key frame 10 or the base end 22 relative to each other in the left-to-right direction, may be provided between the common-to-black-keys base end 23 and the key frame 10 or the second common-to-white-keys base end 22.

The just-mentioned arrangement permits the black key unit BU alone to be easily detached even after the assemblage of the key unit UNT. Also in a mounting process, the black key unit BU can be mounted to the key frame 10 after the key units WU1, WU2 are mounted thereto.

Second Embodiment

Figure 7:
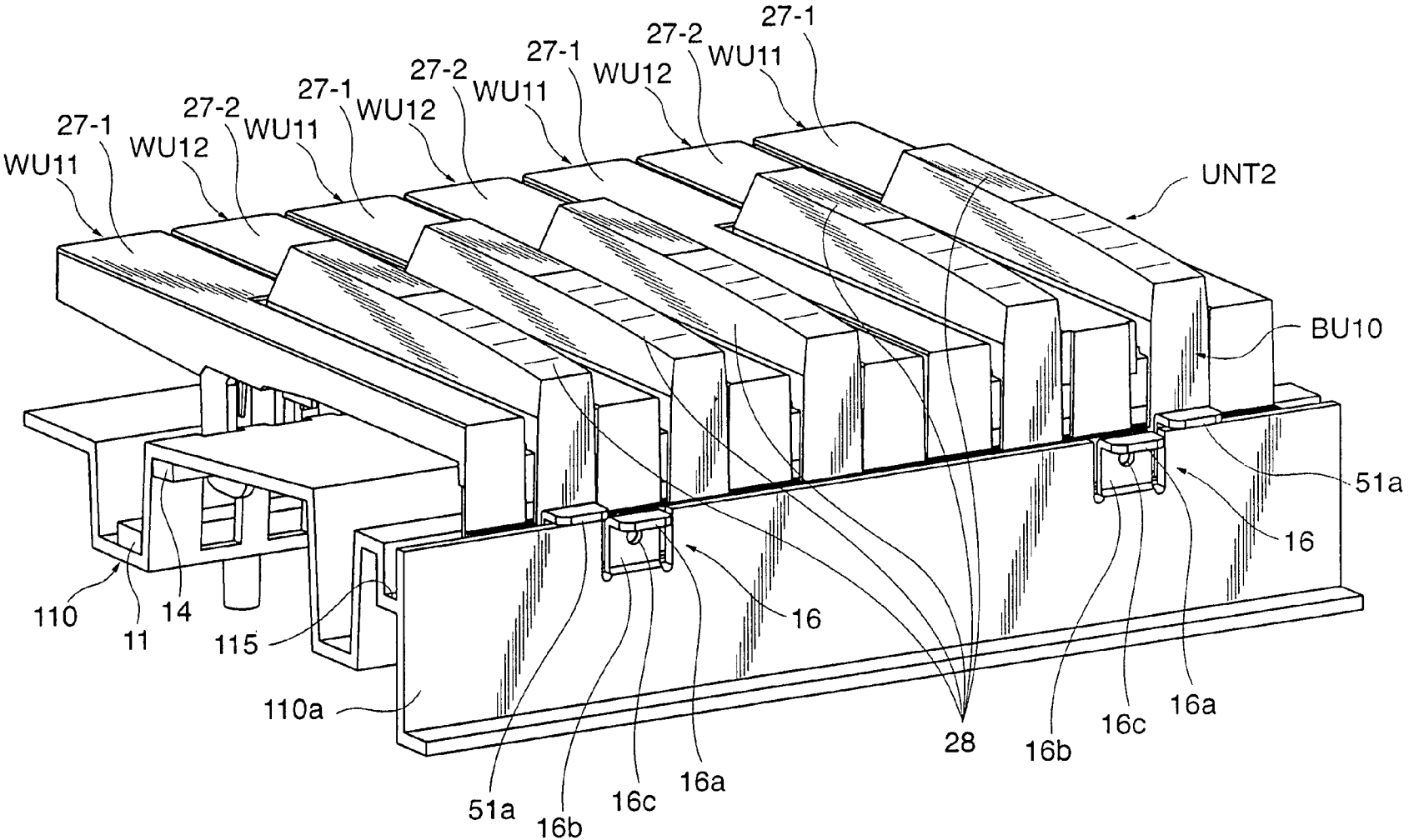
FIG. 7 is a perspective view showing one octave portion of a keyboard apparatus according to a second embodiment of the present invention.

FIG. 7 is a perspective view showing a one-octave part of a keyboard apparatus according to a second embodiment of the present invention. The keyboard apparatus of this embodiment is comprised of a key frame 110 corresponding to the above described key frame 10 to which is mounted a key unit UNT2 corresponding to the key unit UNT. The key unit UNT2 is formed by first and second white key units WU11, WU12 and a black key unit BU 10, which are assembled in a stacked relation.

Figure 8:
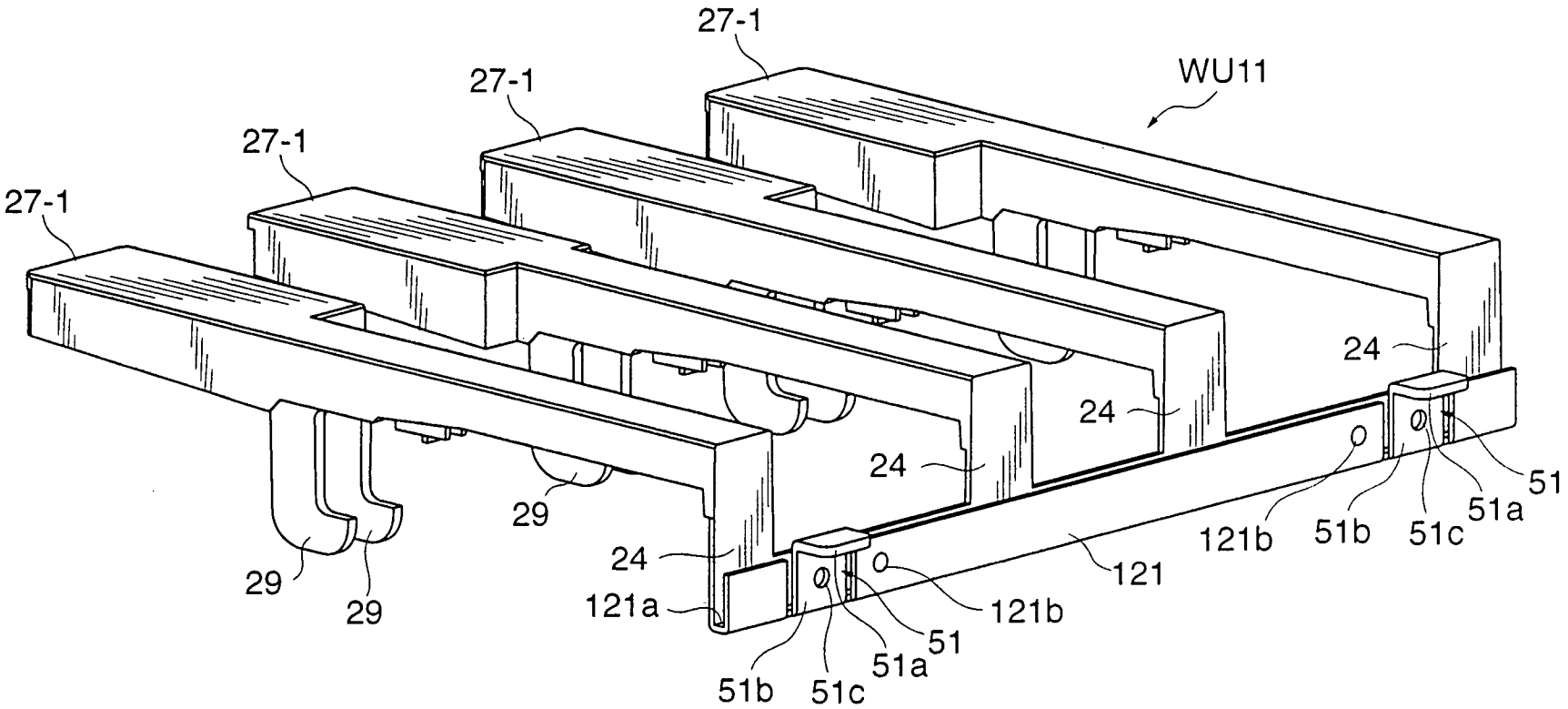
FIG. 8 is a perspective view of a white key unit.
Figure 9A:
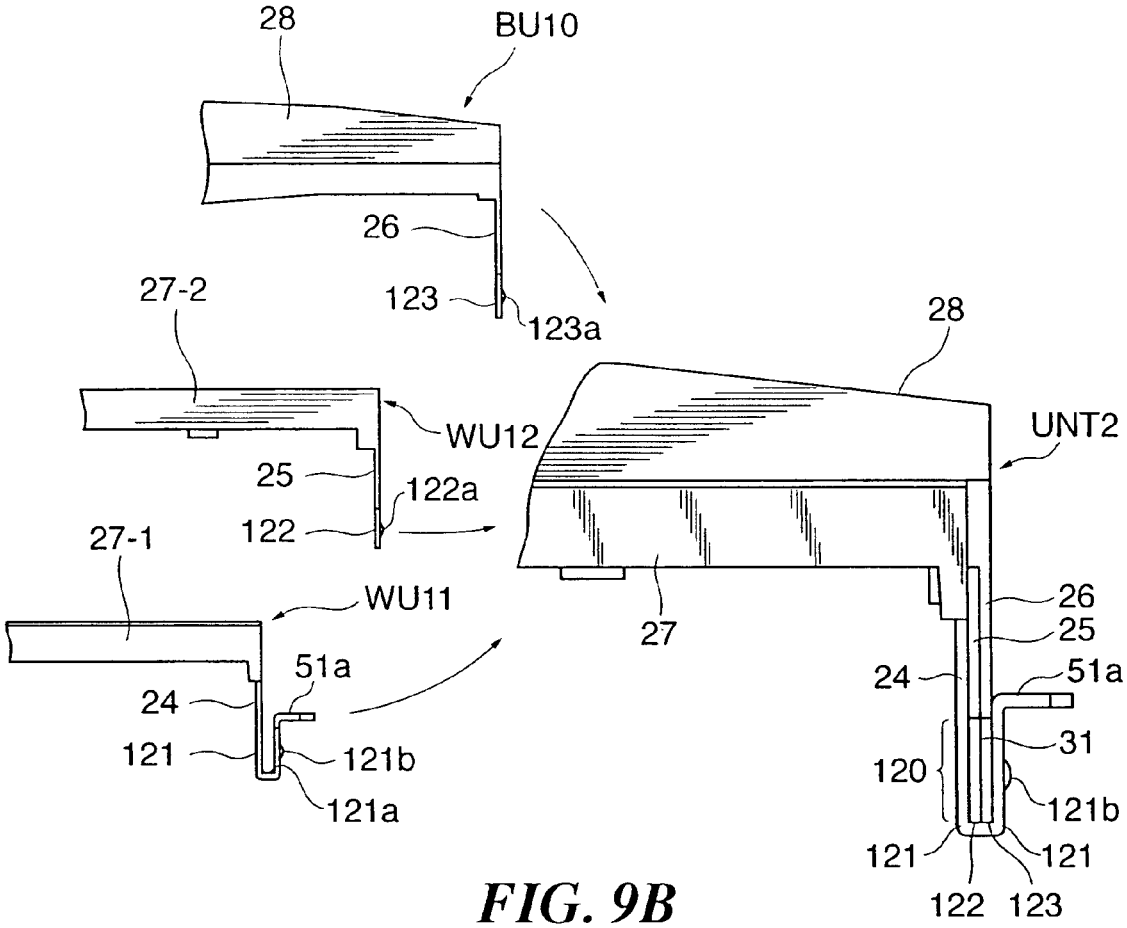
FIG. 9A is a side view showing rear halves of key units.
Figure 9B:
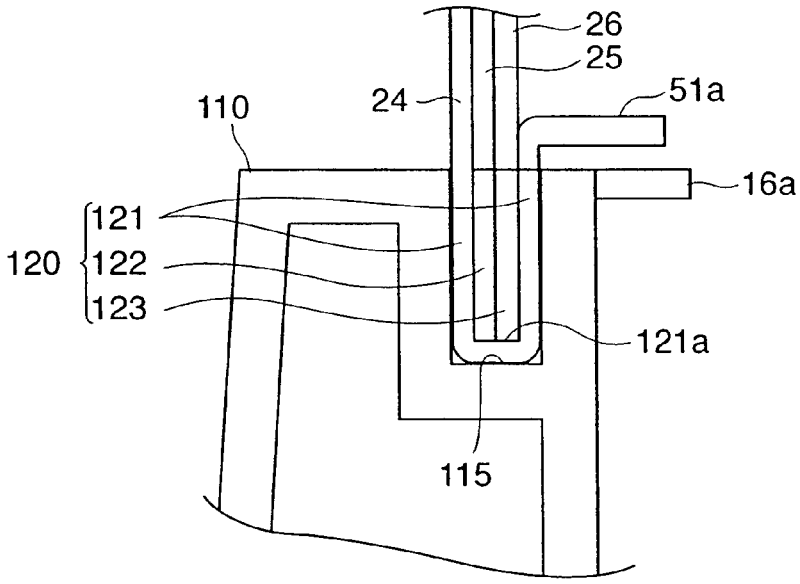
FIG. 9B is a right side view showing a rear end of the keyboard apparatus.
Figure 10:
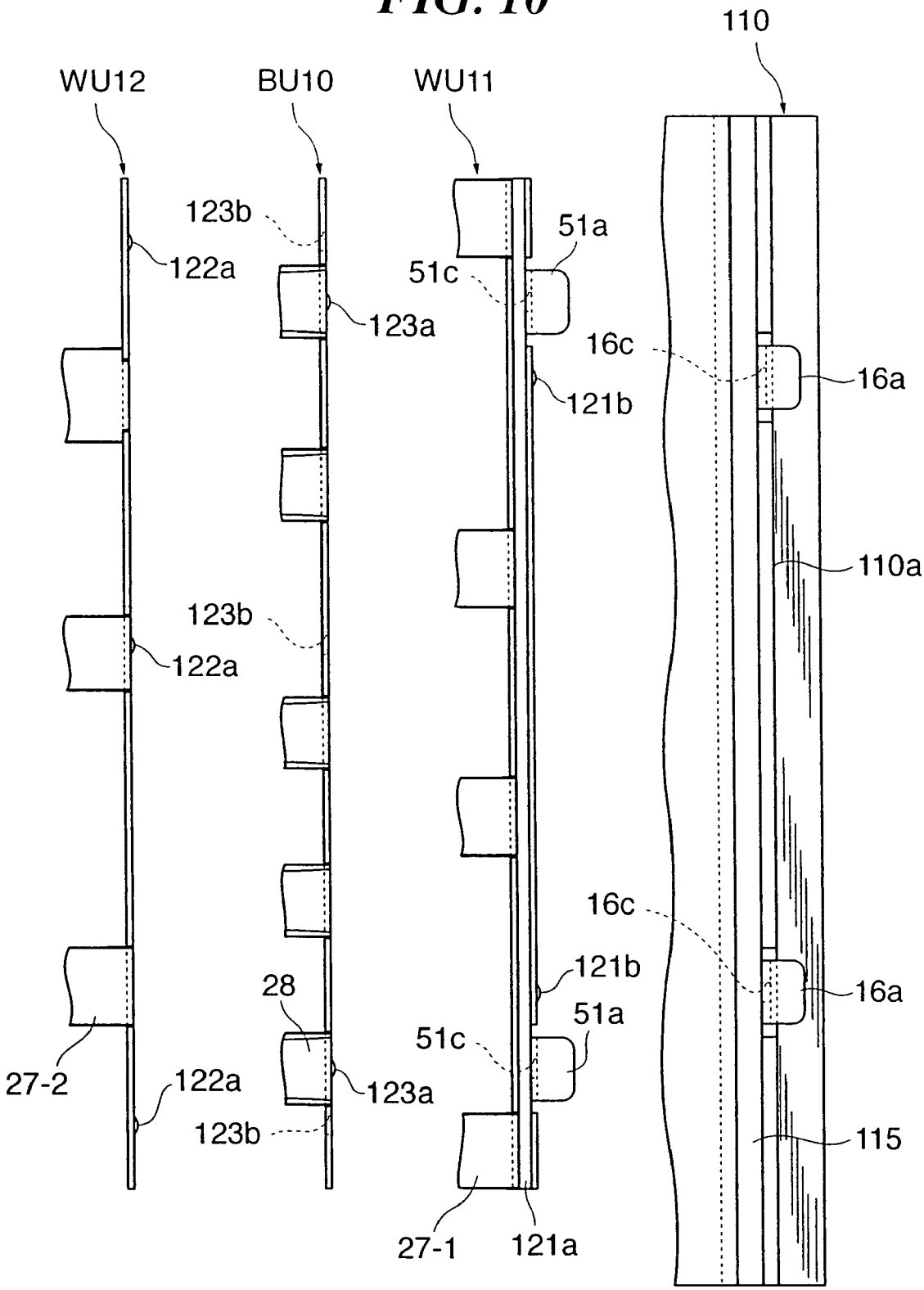
FIG. 10 is a plan view separately showing the key frame and the key unit in a state before they are assembled together.

FIG. 8 is a perspective view of the white key unit WU11. FIG. 9A is a side view showing rear halves of the white key units WU11, WU12, the black key unit BU10, and the key unit UNT2. FIG. 9B is a right side view showing a rear end of the keyboard apparatus. FIG. 10 is a plan view separately showing the key frame 110 and the key unit UNT 2 in a state before they are assembled together. In FIG. 10, the rear ends of the key units WU11, WU12, BU10 are shown in this order from the left side of FIG. 10, and a rear portion 110*a* of the key frame 110 is shown on the rightmost side of FIG. 10. In FIGS. 7 to 10, like elements which are the same as or similar to those of the first embodiment are denoted by like numerals.

As shown in FIGS. 7, 9B, and 10, the key frame 110 is formed at the rear portion 11*a* with a recessed groove 115 corresponding to the recessed groove 15 of the first embodiment. On the rear side of the recessed groove 115, elastic members 16 are integrally formed in the key frame 110 so as to project therefrom. The construction of the elastic members 16 is the same as that of the first embodiment. It should be noted that no elastic member 17 is provided. In other respects, the construction of the key frame 110 is the same as that of the above described key frame 10.

The key units WU11, WU12, BU10 are each made of resin in one piece. White and black key main bodies 27, 28 and hinges 24 to 26 are the same in construction as those of the first embodiment, but common base ends are different in construction from those of the first embodiment.

As shown in FIGS. 8 to 10, hinges 24 of the white key unit WU11 are connected at their lower ends to a first common-to-white-keys base end 121. The first common-to-white-keys base end 121 is bent into a substantially U-shape as seen from side and has a recessed portion 121*a* that opens upward. A shown in FIG. 8, the first common-to-white-keys base end 121 has a rear side plate portion (on the rear side of the recessed portion 121*a*) thereof formed with elastic members 51 so as to project therefrom at a plurality locations (for example, two locations) in the key arrangement direction, the elastic members 51 having the same construction of the above described elastic members 16.

Each of the elastic members 51 has a flexible portion 51*b*. The flexible portion 51*b* is extended upward from the elastic member and integrally formed at its rear surface with protrusions 121*b*, which are formed into a circular shape as seen from rear and correspond to fitting holes 16*c* of the key frame 110. Operation pawl portions 51*a* extended from upper ends of the flexible portions 51*b* are bent rearward. The flexible portions 51*b* are each formed with a circular fitting hole 51*c* so as to extend therethrough in the front-to-rear direction (also refer to FIG. 10).

As shown in FIGS. 9A and 10, the second white key unit WU12 has hinges 25 thereof connected at their lower ends with the second common-to-white-keys base end 122. The second common-to-white-keys base end 122 has its rear surface integrally formed with protrusions 122*a* which are the same in shape as the above described protrusions 121*b*. In other respects, the second common-to-white-keys base end 122 has the same or similar construction as the above described second common-to-white-keys base end 22.

As shown in FIGS. 9A and 10, hinges 26 of the black key unit BU 10 are connected at their lower ends to a common-to-black-keys base end 123 which extends over a length corresponding to one octave. The common-to-black-keys base end 123 is formed with circular fitting holes 123*b* corresponding to the protrusions 122*a* of the second common-to-white-keys base end 122 so as to extend therethrough in the front-to-rear direction (refer to FIG. 10). The common-to-black-keys base end 123 is integrally formed at its rear surface with protrusions 123*a* having the same shape as the above described protrusions 121*b* so as to correspond to the fitting holes 51*c* of the key frame 110 at positions different from that of the fitting holes 123*b* in the key arrangement direction. In other respects, the common-to-black-keys base end 123 has the same construction as the above described common-to-black-keys base end 23.

The key unit UNT2 is integrally assembled in advance and then mounted to the key frame 110. First, the common-to-black-keys base end 123 of the black key unit BU 10 is superimposed on the rear surface of the second common-to-white-keys base end 122 of the second white key unit WU12, and the protrusions 122*a* and the fitting holes 123*b* are fitted to one another. Next, the second common-to-white-keys base end 122 and the common-to-black-keys base end 123 which are superimposed together are fitted to the recessed portion 121*a* of the first common-to-white-keys base end 121 of the first white key unit WU11. At that time, the front-side and rear-side plate portions of the first common-to-white-keys base end 121 are once opened due to their elasticity. Upon completion of the fitting of the base ends to the recessed portion, the protrusions 123*a* are fitted into the fitting holes 51*c*.

As a result, the first and second common-to-white-keys base ends 121, 122 and the common-to-black-keys base end 123 are stacked in three layers, and the stacked layers form a common-to-all-keys common base end 120 corresponding to the above described common-to-all-keys base end 20 (refer to FIGS. 9A and 9B). By the fitting of the protrusions 122*a* to the fitting holes 123*b* and the fitting of the protrusions 123*a* to the fitting holes 51*c*, the positions of the second white key unit WU12 and the black key unit BU10 relative to the first white key unit WU 11 are restricted in the vertical direction and the left-to-right direction.

The common-to-all-keys base end 120 of the key unit UNT2 which is comprised of the white and black key units stacked in three layers is fitted from above to the recessed groove 115 of the key frame 110. As a result, the elastic member 16 is elastically deformed, and then the protrusions 12*b* of the first common-to-white-keys base end 121 are fitted to the fitting holes 16*c* of the key frame 110. By the fitting of the protrusions 121*b* to the fitting holes 16*c*, the positions of the common-to-all-keys common base end 120 relative to the key frame 110 are restricted in the left-to-right direction and the vertical direction. In this manner, the common-to-all-keys base end 120 is elastically fitted and fixed to the recessed groove 115, whereby the mounting of the key unit UNT2 to the key frame 110 is completed.

An operation of removing the key unit UNT2 from the key frame 110 is the same as the first embodiment. To detach the second common-to-white-keys base end 122 and the common-to-black-keys base end 123 from the recessed portion 121*a* of the first common-to-white-keys base end 121 of the first white key unit WU11 in order to disassemble the key unit UNT2, the two pawl portions 51*a* are urged rearward and the base ends are pulled out upward. The other functions at the time of assemblage and disassemblage are the same as the first embodiment.

According to this embodiment, effects similar to those attained by the first embodiment can be attained. In addition, since the second common-to-white-keys base end 122 and the common-to-black-keys base end 123 are fitted to and retained by the recessed portion 121*a* of the first white key unit WU11, the key unit UNT2 can further easily be handled before it is assembled to the key frame 110.

Third Embodiment

In the above described first and second embodiments, protrusions and fitting holes are provided between adjacent ones of the common-to-white-keys base end, the common-to-black-keys base end, and the key frame. However, one protrusion may be fitted to two or more fitting holes.

Figure 11A:
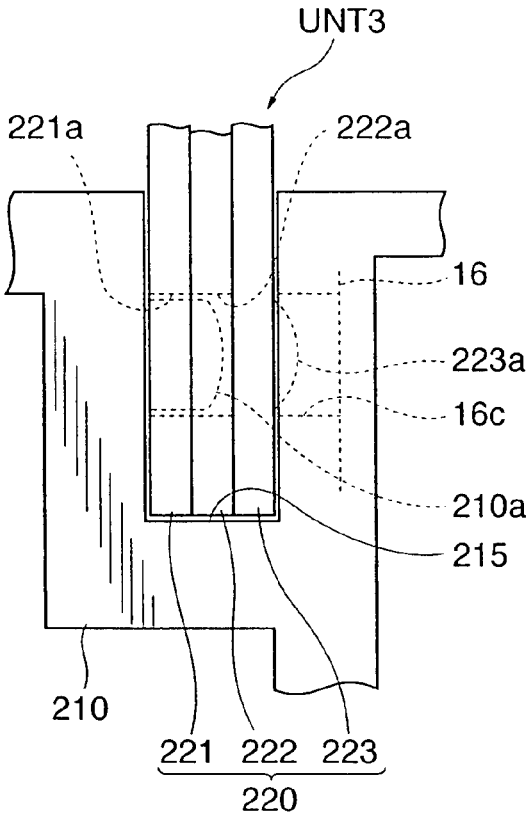
FIG. 11A is a right side view showing a rear end of a keyboard apparatus according to a third embodiment of the present invention.
Figure 11B:
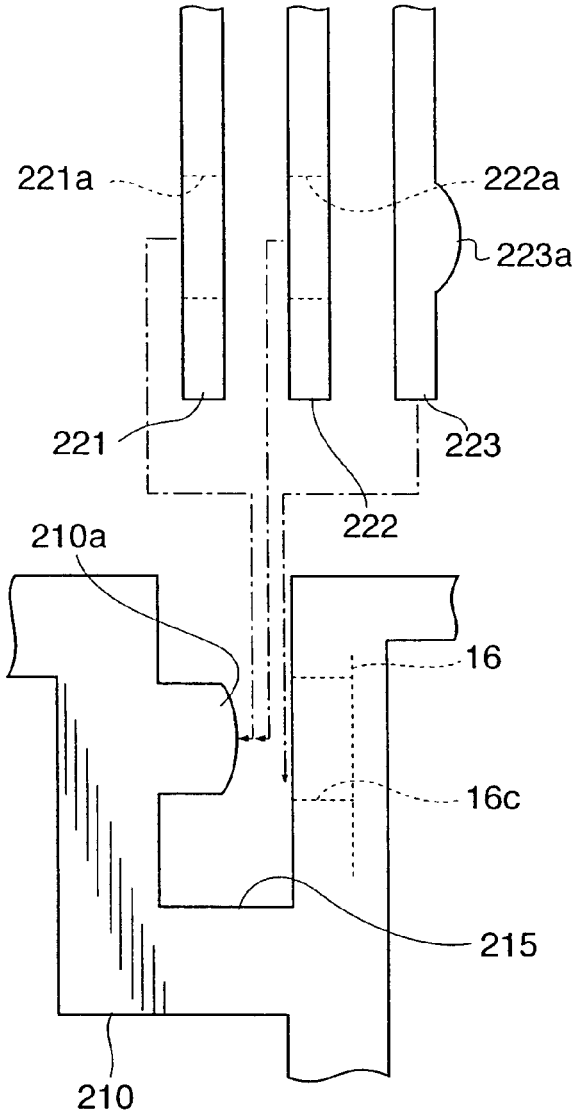
FIG. 11B is a schematic view showing how a common-to-all-keys base end is mounted to the key frame.

FIG. 11A is a right side view showing a rear end of a keyboard apparatus according to a third embodiment. The keyboard apparatus of this embodiment includes a key frame 210 corresponding to the key frame 10, to which a key unit UNT3 corresponding to the key unit UNT is mounted. FIG. 11B is a view schematically showing an arrangement in which a common-to-all-keys base end 220 is assembled to the key frame 210.

As shown in FIGS. 11A and 11B, in the key unit UNT3, first and second common-to-white-keys base end 221, 222, and a common-to-black-keys base end 223 corresponding the above described first and second common-to-white-keys base end 21, 22 and the common-to-black-keys base end 23 are stacked together, whereby a common-to-all-keys base end 220 is formed which corresponds to the common-to-all-keys base end 20.

The first and second common-to-white-keys base ends 221, 222 are formed with fitting holes 221*a*, 222*a* corresponding to the fitting holes 21*b* (refer to FIG. 6). The common-to-black-keys base end 223 is integrally formed at a rear surface thereof with protrusions 223*a* corresponding to the protrusions 23*a*. The key frame 210 is formed with a recessed groove 215 corresponding to the above described recessed groove 15. As in the case of the first embodiment, on the rear side of the recessed groove 215, there are provided elastic members 16 each formed with a fitting hole 16*c* corresponding to the protrusion 223*a* concerned.

The key frame 210 is formed with protrusions 210*a* at portions of the key frame on the front side of the recessed groove 215. It should be noted that the above described elastic members 17 may be provided and the protrusions 210*a* may be formed in the elastic members 17 so as to project therefrom. The protrusions 210*a* correspond to the fitting holes 221*a*, 222*a*. Each protrusion 210*a* is longer than the length of the fitting hole 221*a* in the front-to-rear direction, but is shorter than the total length of the fitting hole 221*a* and the fitting hole 222*a*. In other respects, the construction is the same as that of the first embodiment.

With the above construction, when the key unit UNT3 is mounted to the key frame 210, as shown in FIG. 11B, the first common-to-white-keys base end 221 is first inserted from above into the recessed groove 215 and is then moved forward, whereby the fitting holes 221*a* are fitted to the protrusions 210*a*. Similarly, the second common-to-white-keys base end 222 is inserted from above into the recessed groove 215 and is then moved forward to cause the fitting holes 222*a* to be fitted to the protrusions 210*a*. Next, the common-to-black-keys base end 223 is inserted from above and fitted into the recessed groove 215, whereby the elastic members 16 are elastically deformed and the protrusions 223*a* are fitted into the fitting holes 16*c*.

As a result, the common base ends are stacked together in layer to form the common-to-all-keys base end 220. At the same time, the common-to-all-keys base end 220 is elastically fitted and fixed to the recessed groove 215, whereby the mounting of the key unit UNT3 to the key frame 210 is completed.

According to the present invention, it is possible to suppress the depth size of the keyboard apparatus and mount the key unit to the key frame with a simple operation, and therefore, effects similar to those of the first embodiment can be achieved, except for the white key units and the black key unit are assembled into the key unit, which is then mounted.

It should be noted that in order to assemble the key unit UNT3 into one piece using the protrusions 210*a*, the protrusions 210*a* may be made longer than the total length of the fitting holes 221*a*, 222*a* but shorter than the total thickness of the common-to-all-keys base end 220, and the common-to-black-keys base end 223 may be formed with fitting holes to which the protrusions 210*a* are fitted, instead of forming therein the protrusions 223*a* and the fitting holes 16*c*. In that case, elastic members capable of being deformed in the front-to-rear direction are provided in portions of the key frame 210 facing the first common-to-white-keys base end 221, and the protrusions 210*a* are formed in the elastic members. As a result, when the common-to-black-keys base end 223 is inserted into the recessed groove 215, the elastic members are deformed forward to permit the base end to be inserted and fitted.

It should be noted that in the above described first to third embodiments, the common base ends are fitted and fixed to the key frame, mainly using elasticity of the key frame. This is not limitative. For example, the elastic deformation of either the common base ends or the key frame or the elastic deformations of both the common base ends and the key frame may be utilized for fitting and fixing the common base ends to the key frame. Although the two white key units are employed in the embodiments, these key units may be put into one piece. In other words, the key unit may be a divided-into-two construction comprised of the one-piece white key unit and the black key unit.

Figure 12:
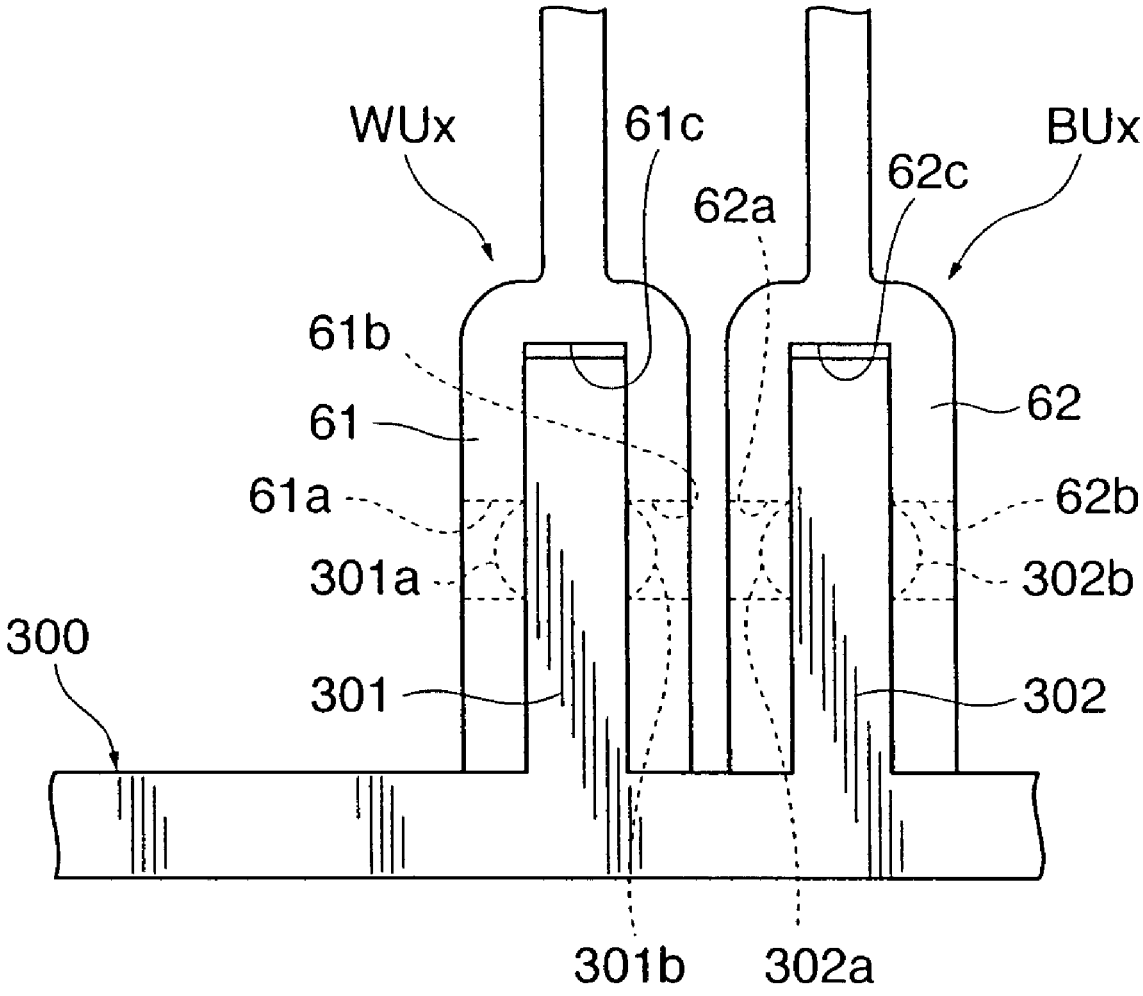
FIG. 12 is a view showing from side a rear end of a keyboard apparatus according to a modification.

For example, in a keyboard apparatus according to a modification having a rear end thereof shown in a side view of FIG. 12, a one-piece white key unit WUx corresponding to the first and second white key units WU1, WU2 is formed separately from a black key unit BUx. A common-to-white-keys base end 61 of the white key unit WUx is formed with a recessed groove 61*c*, which is formed into a U-shape and opens downward as seen from side. Similarly, a common-to-black-keys base end 62 of the black key unit BUx is formed with a U-shaped recessed groove 62*c*. The common-to-white-keys base end 61 is formed with fitting holes 61*a*, 61*b* so as to extend therethrough, and the common-to-black-keys base end 62 is also formed with fitting holes 62*a*, 62*b* so as to extend therethrough.

A key frame 300 is formed at its upper portion with ridge-like supports 301, 302 so as to protrude therefrom and extend in the key arrangement direction. The supports 301, 302 are provided at their opposite sides in the front-to-rear direction with protrusions 301*a*, 301*b*, 302*a*, 302*b* so as to project therefrom, which correspond to the fitting holes 61*a*, 61*b*, 62*a*, 62*b*.

In the above arrangement, when the supports 301, 302 are inserted into the recessed grooves 61*c*, 62*c*, the common-to-white-keys base end 61 and the common-to-black-keys base end 62 are elastically deformed, and then the supports 301, 302 are fitted into the recessed grooves 61*c*, 62*c*. At that time, the protrusions 301*a*, 301*b*, 302*a*, 302*b* are fitted into the fitting holes 61*a*, 61*b*, 62*a*, 62*b*.

As described above, elastic deformations of the white key unit WUx and the black key unit BUx may mainly be utilized for fitting and fixing the common base ends 61, 62 to the key frame 300.

It should be noted that although the key units UNT, UNT2, UNT3 in the above described embodiments are each constructed to cover one octave, this is not limitative. Each of the key units may be constructed to cover a predetermined tone region including a plurality of keys. Furthermore, the number of the white key units and the number of the black key unit of one key unit UNT or the like are not limited. It is not essentially required to form the key unit UNT or the like by dividing the same into the white key unit and the black key unit. The key unit UNT or the like may be formed by one key unit that includes a plurality of white keys and a plurality of black keys belonging to the predetermined tone region.

It should be noted that in the above described embodiments, as a mechanism for restricting the positional relation between the common base ends or between the common base ends and the key frame, a combination of protrusions and fitting holes (such as the protrusions 17*a* and the fitting holes 21*b*, and the protrusions 23*a* and the fitting holes (refer to FIG. 6)) has been described as an example, but this is not limitative. For example, the relationship of protrusions and fitting holes (relationship of concavity and convexity) may be reversed. Furthermore, the fitting holes may not be through holes and may be engagement portions such as recesses which permit protrusions to abut thereagainst or to be fitted therewith, and the number of the engagement portions is not limited. In particular, a mechanism for preventing the common-to-all-keys base end from being detached from the key frame is not limited to being constructed by protrusions and fitting holes. For example, the common-to-all-keys base end may be formed with engagement portions, and the key frame may be provided with a mechanism such as pawls for being engaged with the engagement portions, by which the common-to-all-keys base end is pressed downward.

In considering, with reference to the above described embodiments, a minimum construction for mounting the key unit to the key frame and preventing the key unit from being detached from the key frame using elastic deformation with a simple operation, it is enough to construct at least one of the common-to-all-keys base end and the key frame so as to be able to be elastically deformed and provide a mechanism for restricting the position of the common-to-white-keys base end of the stacked common-to-all-keys base end relative to the key frame in the vertical direction and the left-to-right direction at some part of the common-to-white-keys base end. Such a position restricting mechanism is not necessary to have the common-to-black-keys base end, as described above. In particular, in the case of the white key unit formed by two or more divided units, it is enough to provide a mechanism for restricting the positional relationship between the common base ends of the divided units.

It should be noted that although the hinges 24 to 26 are extended in the vertical direction in the above described embodiments, it is enough, from the viewpoint of reducing the depth size of the keyboard apparatus as small as possible and improving the locus of the key depression surfaces 27*a*, 28*a*, to construct these hinges so as to cross the key depression surfaces 27*a* and extend in parallel to the key arrangement direction. For example, therefore, the hinges 24 to 26 may obliquely extend downward rearward. Furthermore, the common base end may not extend parallel to the hinges 24 to 26 and may not be equal in thickness from one another. There may be a step difference between the hinges 24 to 26 as viewed in the front-to-rear direction.

What is claimed is:

1. A keyboard apparatus comprising:

a key unit having a plurality of key main bodies each of the key bodies is able to be supported for pivotal motion in a key depression/release direction by a common base end via a corresponding one of thin plate-like hinges; and a key frame having a base end support able to fixedly support the common base end of said key unit, wherein the hinges of said key unit are formed to extend in a direction to cross key depression surfaces of the key main bodies and parallel to a key arrangement direction, and wherein the common base end is fitted and fixed to the base end support using elastic deformation of at least one of the common base end of said key unit and the base end support of said key frame.

2. The keyboard apparatus according to claim 1, wherein one of the common base end and the base end support is formed with a recessed groove extending in the key arrangement direction, and another of the common base end and the base end support is formed with a ridge-like protrusion extending in the key arrangement direction and able to be fitted to the recessed groove.

3. The keyboard apparatus according to claim 1, wherein said key unit is comprised of at least one white key unit and one black key unit which are disposed in a stacked relation, the common base end fitted and fixed to the base end support is comprised of a common-to-white-keys base end of the white key unit and a common-to-black-keys base end of the black key unit, which are stacked together, the base end support is formed with a recessed groove extending in the key arrangement direction, and the common base end is formed with a ridge-like protrusion able to be fitted to the recessed groove and extending in the key arrangement direction.

4. The keyboard apparatus according to claim 3, wherein the key unit includes position restriction means able to restrict a positional relationship between the white key unit and the black key unit in the key arrangement direction, in a state where the white key unit and the black key unit have been disposed in a stacked relation but have not been mounted to the key frame.

5. The keyboard apparatus according to claim 1, wherein one of the common base end and the base end support is formed with protrusions, and another of the common base end and the base end support is formed with fit portions able to be fitted with the protrusions when the common base end is fitted and fixed to the base end support, whereby a position of the common base end relative to the base end support in the key arrangement direction and in a vertical direction is restricted when the protrusions are fitted to the fit portions.

* * * * *